US011143978B2

(12) United States Patent
Chang et al.

(10) Patent No.: US 11,143,978 B2
(45) Date of Patent: Oct. 12, 2021

(54) CHARGE ROLLER GAP DETERMINATION

(71) Applicant: Hewlett-Packard Development Company, L.P., Spring, TX (US)

(72) Inventors: Seongsik Chang, Palo Alto, CA (US); Omer Gila, Palo Alto, CA (US); Daniel Espinosa, Palo Alto, CA (US); Anthony W. McLennan, Palo Alto, CA (US); Eyal Lovton, Ness Ziona (IL); Asael Degany, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/256,340

(22) PCT Filed: Oct. 11, 2018

(86) PCT No.: PCT/US2018/055371
§ 371 (c)(1),
(2) Date: Dec. 28, 2020

(87) PCT Pub. No.: WO2020/076318
PCT Pub. Date: Apr. 16, 2020

(65) Prior Publication Data
US 2021/0223711 A1 Jul. 22, 2021

(51) Int. Cl.
*G03G 15/02* (2006.01)
*G03G 15/00* (2006.01)

(52) U.S. Cl.
CPC ..... *G03G 15/0266* (2013.01); *G03G 15/0233* (2013.01); *G03G 15/5037* (2013.01)

(58) Field of Classification Search
CPC ..... G03G 15/0233; G03G 15/0266; G03G 15/0283; G03G 15/5037
USPC ..... 399/38, 50, 107, 110, 115
See application file for complete search history.

(56) References Cited

U.S. PATENT DOCUMENTS

| | | | | |
|---|---|---|---|---|
| 5,164,779 | A | 11/1992 | Araya et al. | |
| 5,305,177 | A | 4/1994 | Aoki et al. | |
| 6,052,550 | A | 4/2000 | Thornton et al. | |
| 6,904,253 | B2 | 6/2005 | Hosokawa et al. | |
| 7,050,742 | B2 | 5/2006 | Gila et al. | |
| 7,298,993 | B2 | 11/2007 | Lee et al. | |
| 9,423,717 | B2 | 8/2016 | Chang et al. | |
| 9,513,572 | B2 * | 12/2016 | Gila | G03G 15/0266 |
| 9,665,032 | B2 | 5/2017 | Shibuya | |
| 10,001,719 | B2 | 6/2018 | Kihara et al. | |
| 10,078,287 | B2 * | 9/2018 | Nagahashi | G03G 15/0283 |
| 2017/0045838 | A1 | 2/2017 | Chang et al. | |
| 2017/0351192 | A1 | 12/2017 | Ikada et al. | |

FOREIGN PATENT DOCUMENTS

| | | | |
|---|---|---|---|
| CN | 1193131 | A | 9/1998 |

* cited by examiner

*Primary Examiner* — Hoan H Tran
(74) *Attorney, Agent, or Firm* — Dicke Billig & Czaja PLLC

(57) ABSTRACT

A device includes a charge roller and a control portion. The charge roller is removably insertable to be in charge-transferring relation to, and spaced apart by a first air gap from, a photoconductive imaging portion of an electrophotographic printer. The control portion is to determine a size of the first air gap based on determination of a charging threshold voltage associated with the charge roller.

15 Claims, 8 Drawing Sheets

CHARGE ROLLER GAP DETERMINATION

BACKGROUND

Liquid electrophotography has revolutionized high speed and high volume printing. Via liquid electrophotography, digital printers or presses perform print jobs without films or the plates that are typically associated with traditional offset lithography. Accordingly, among other features, a press operator can change the content while the digital press is still completing other jobs, allowing digital printing services to be more nimble and flexible than printing services employing traditional offset lithography.

DETAILED DESCRIPTION

Figure 1:
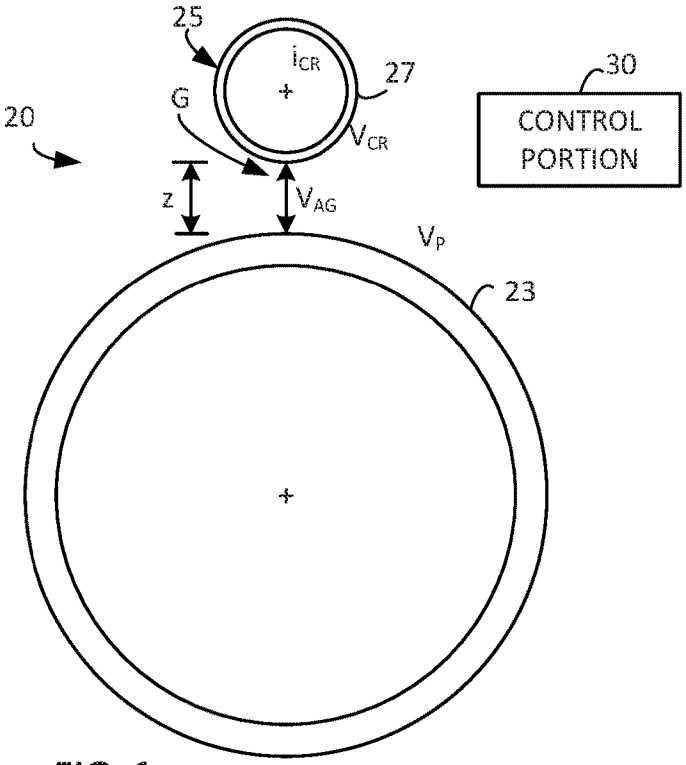
FIG. 1 is a side view schematically representing an example portion of an electrophotographic printer including a charge roller and control portion.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure are directed to determining a size of an air gap, at or around a time of installing a charge roller, between the charge roller and a photoconductive imaging portion of an electrophotographic printer. Accordingly, the determination is made prior to operating the printer to produce printed images on a medium.

In some examples, determining the size of the air gap, for a particular charge roller, may help ensure desired operation of the electrophotographic printer such as by at least confirming that the size of the air gap corresponds to a size which is conducive to uniform or substantially uniform charging of the photoconductive imaging portion via an air ionization process across the air gap. With this in mind, it will be noted that various factors may affect the suitability of a particular manufactured charge roller in an electrophotographic printer. For instance, in some examples at least the following components of an electrophotographic printer may each exhibit their own tolerances: a photoconductor drum size; a thickness of an imaging portion of the photoconductor drum; a charge roller diameter; a diameter of drive components (e.g. roller, disc, etc.) responsible for rotation of, and/or gap positioning, of the charge roller and/or photoconductor drum. Given all the tolerances which may affect the consistency of an air gap between a charge roller and a photoconductive imaging portion, at least some example devices and/or example methods of the present disclosure facilitate quick and reliable determination of a size of the air gap when a particular manufactured charge roller is installed. For instance, if the size of the air gap is not suitable, a different manufactured charge roller may be installed and/or other adjustments may be made.

Accordingly, in some examples of the present disclosure, a device comprises a charge roller and a control portion. The charge roller is removably insertable to be in charge-transferring relation to, at a first air gap from, a photoconductive imaging portion of an electrophotographic printer. In some examples, the control portion is to determine a charging threshold voltage associated with the charge roller and to determine a size of the first air gap, via the determined charging threshold voltage, based on an array of different charging threshold voltages, including the determined charging threshold voltage, corresponding to an array of differently sized air gaps, including the size of the first air gap. In some such examples, the charging threshold voltage corresponds to a voltage of the charge roller at (or above) which charging of a photoconductive imaging portion via air ionization may occur.

In some examples, the control portion is to determine the size of the first air gap and underlying determination of the charging threshold voltage, without receiving external physical measurement information or external electronic measurement information, such as information obtained via instrumentation separate from, and independent of, the electrophotographic printer.

Via at least some examples of the present disclosure, a determination of the size of the gap can be made in increments on the order of ten micrometers or less.

In sharp contrast, some external physical measurement tools provide air gap measurements on the order of dozens of micrometers, and also may involve the insertion of such tools into, and around, sensitive parts of the electrophotographic printer. One such external measurement tool may comprise a feeler gauge. In some instances, accuracy of the feeler gauge can be compromised in measuring an air gap involving a charge roller because use of the feeler gauge may involve forcing the element of the feeler gauge into the gap to be measured.

In further sharp contrast, some external electronic measurement tools rely on capacitance-based gap measurements and may involve the use of multiple tools, such as custom capacitance meters, oscilloscope, etc.

However, via the example arrangements described herein, a size of an air gap may be quickly and accurately determined via use of a measurement of a voltage of the charge roller and a photoconductor voltage (or charge roller current), whose measurement tools are already installed or present (e.g. on-board) in the printer, without such external or extra measurement tools.

It will be understood that, in at least some examples throughout the present disclosure, a size of an air gap (between a charge roller and a photoconductor) may correspond to an average size of an air gap. For example, a charge roller may have variations in its diameter or circumference at locations between opposite outer ends of the charge roller, may exhibit runout, etc. which may cause the air gap between the charge roller and the photoconductor to be non-uniform.

These examples, and additional examples, are further described below in association with FIGS. 1-11.

FIG. 1 is a diagram including a side view schematically representing a portion 20 of an example electrophotographic printer.

As shown in FIG. 1, the portion 20 comprises a charge roller 25 and a control portion 30. The charge roller 25 is positioned to be in charge-transferring relation to, and spaced apart by an air gap G from, a photoconductive imaging portion 23. In general terms, the charge roller 25 is in charge-transferring relation with the photoconductive imaging portion 23 in order to deposit an electric charge on the photoconductive imaging portion 23 during operation of the printing system for printing. In some such examples the charging may occur at charge roller voltages at or above a charging threshold voltage, such as a Paschen voltage.

In some examples, the control portion 30 is to determine a size z of the air gap G.

In some examples, the determination of the size z of the air gap G can be made based on a determination of the charging threshold voltage of the charge roller 25, as installed, in charge-transferring relation to the photoconductive imaging portion 23. Accordingly, in some examples, the control portion 30 comprises instructions to determine a size z of the air gap G at least based on instructions to determine, and/or to receive, the charging threshold voltage.

In some examples, a determination of the charging threshold voltage can be made based on a first measured voltage (e.g. $V_{CR}$) of the charge roller 25, a second measured voltage (e.g. $V_P$) of the photoconductive imaging portion 23, and/or a measured current (e.g. $i_{CR}$) of the charge roller. Accordingly, in some examples, the control portion 30 includes instructions to receive the first measured voltage of the charge roller, to receive the second measured voltage of the photoconductive imaging portion, and/or to receive the measured current of the charge roller.

In some such examples, the respective first measured voltage, second measured voltage and/or first measured current are determined via elements, tools, instrumentation, etc. which are on-board the electrophotographic printer, and therefore the control portion 30 receives this information (e.g. measured voltages, currents, etc.) from the electrophotographic printer itself. In some such examples, via such elements, tools, instrumentation, etc. the respective measured values are automatically determined via the electrophotographic printer upon installation of the first charge roller into charge-transferring relation with the photoconductive imaging portion.

However, in some examples, at least one of the first measured voltage, second measured voltage, and/or measured current are determined via user interaction with the printer and then received as information to be used and/or stored in the control portion 30 of the electrophotographic printer.

In some examples, the charging threshold voltage is determined using information which is stored on-board (e.g. via control portion 30), and/or otherwise accessible via, the electrophotographic printer. In some such examples, this stored information (used to determine the charging threshold voltage) is used in association with user-measured parameters, such as a user-obtained respective first measured voltage, second measured voltage, and/or first measured current upon installation of the first charge roller (into charge-transferring relation to the photoconductive imaging portion). However, in some such examples, this stored information (used to determine the charging threshold voltage) is used in association with the parameters (e.g. first measured voltage, second measured voltage, and/or first measured current) automatically obtained by the electrophotographic printer upon installation and operation of the first charge roller (into charge-transferring relation to the photoconductive imaging portion).

In some examples, at least some of the stored information by which the size z of the air gap G may be determined includes stored information such as a designation for each charging threshold voltage in an array or range of different charging threshold voltages of a one-to-one correspondence with a particular sized air gap in an array or range of differently sized air gap sizes. Accordingly, upon determining a particular charging threshold voltage, this stored information may be used to find the corresponding sized air gap G. In some examples, this stored information regarding the one-to-one correspondence of charging threshold voltages and sizes of an air gap are stored in association with control portion 30. In some such examples, this stored information may take the form of a reference tool (e.g. lookup table) to find the corresponding sized air gap. As later described in association with at least FIG. 5B, graph 170 provides an example graphical representation of at least some of this stored information regarding the one-to-one correspondence between the various charging threshold voltages and air gap sizes.

In this way, a user, installer, operator, etc. at the electrophotographic printer can determine whether the charge roller 25, upon installation, produces an air gap z relative to the photoconductive imaging portion 23 which is within a suitable range of acceptable air gaps for desired performance of the charge roller in uniformly or substantially uniformly charging the photoconductive imaging portion 23.

In some examples, upon a determination that the air gap z is not within the suitable range, another charge roller 25 can be inserted and evaluated for a suitable air gap z. In some examples, upon a determination that the air gap z is not within the suitable range, a manual or automatic adjustment may be implemented to change the spacing between the charge roller 25 and the photoconductive imaging portion 23 in order to achieve an air gap z within the suitable range of acceptable air gaps.

Figure 2:
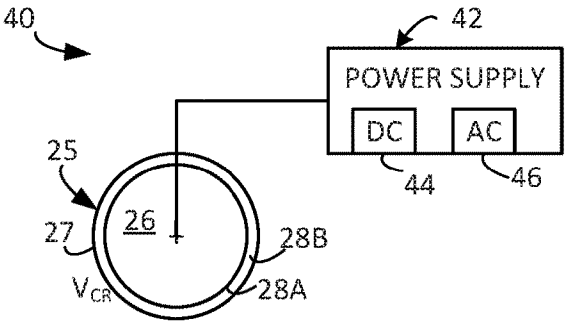
FIG. 2 is a side view schematically representing an example portion of an electrophotographic printer including a charge roller and power supply portion.

In some examples, the first voltage $V_{CR}$ of charge roller 25 (e.g. at an external surface 27, and may be determined from a power supply voltage monitor, such as implemented as at least part of the example power supply portion 42 shown in FIG. 2. As shown in FIG. 1, a voltage across the air gap G may be represented via identifier $V_{AG}$.

Figure 5A:
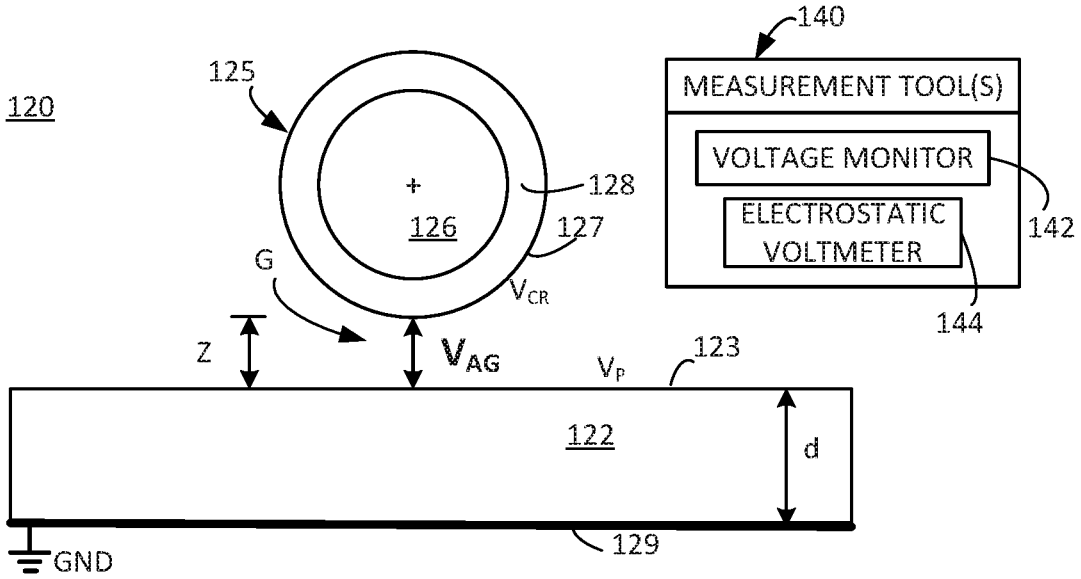
FIG. 5A is a side view schematically representing an example portion of an electrophotographic printer including a charge roller positioned with a gap relative to an example photoconductive imaging portion.

In some examples, the photoconductive imaging portion 23 forms an outer layer of a photoconductor drum, such as but not limited to, the photoconductor drum 328, as further described later in association with at least FIGS. 8-9, or photoconductive imaging portion 123 in FIG. 5A. As shown in FIG. 1, a voltage of the photoconductive imaging portion 23 is represented by identifier $V_P$, and in some examples, may be determined from a measurement tool, such as but not limited to, an electrometer. In some such examples, the measurement tool may comprise a non-contact electrostatic voltmeter. As noted above, in some examples, the above-noted example measurement tools or other measurement tools may be an on-board measurement tool of the electrophotographic printer. At least some example measurement tools 140 are schematically represented later in association with at least FIG. 5A. As shown in FIG. 5A, in some examples measurement tool(s) 140 may comprise the above-noted electrostatic voltmeter 144, which in some examples comprises a non-contact electrostatic voltmeter locatable a few millimeters away from a surface of the photoconductive imaging portion (e.g. 23 in FIG. 1; 123 in FIG. 5A). In some such examples, this electrostatic voltmeter may comprise an on-board measurement tool comprising a portion of the electrostatic printer. As further shown in FIG. 5A, in some examples the measurement tool(s) 140 may comprise a voltage monitor 142, which comprises one example implementation of a voltage supply monitor which may form part of, or be used in association with, a power supply portion 42 for measuring at least charge roller voltage. Power supply station 42 is later described in association with at least FIG. 2.

In some examples, the control portion 30 may be implemented as, and/or comprise at least some of substantially the same features and attributes as the control portion 1000 as later described in association with at least FIGS. 10A-10B. In some such examples, control portion 30 may comprise the above-described stored information and/or provide access to such stored information. Accordingly, the above-described stored information may comprise or be implemented as the stored information 1012 in FIG. 10A, in some examples.

It will be understood that the elements shown in FIG. 1 are depicted for illustrative purposes and are not necessarily to scale. For example, in at least some instances the charge roller 25 may be much smaller in proportion relative to a drum providing photoconductive imaging portion 23.

FIG. 2 is a diagram including a side view schematically illustrating a portion 40 of an example electrophotographic printer. In some examples, the portion 40 comprises at least some of substantially the same features and attributes as the portion 20 in FIG. 1. In some examples, portion 40 may comprise a charge roller 25 and a power supply portion 42. In some examples, the external surface 27 of charge roller 25 comprises a hard external surface. Moreover, in some examples, the external surface 27 may comprise a metal surface 28A and a hard resistive layer 28B overlying the metal surface 28A. In some examples, the resistive layer 28B comprises an inorganic, non-polymeric material. Via some such example arrangements, the example charge roller 25 may sometimes referred to in this description as being "permanent" at least in the sense that once installed (e.g. removably inserted), the charge roller 25 may have a longevity corresponding to a longevity of the electrophotographic printer in which it is installed or at least a longevity significantly greater than typical charge rollers.

In some examples, the power supply 42 generates a voltage potential $V_{CR}$ at the external surface 27 of the charge roller 25. The external surface 27 of the charge roller 25 is disposed to deposit an electric charge on, the photoconductive imaging portion 23.

It will be understood that the power supply portion 42 is coupled relative to the charge roller 25 in a manner to permit rotation of the charge roller 25 relative to the photoconductive imaging portion 23 while supplying and controlling the charge roller voltage $V_{CR}$. In some examples, power supply 42 charges the charge roller 25 (and thereby charges photoconductive imaging portion 23) via a DC component 44, an AC component 46, or a combination of both.

As previously noted in association with FIG. 1, a size z (e.g. quantitative value) of the air gap between the external surface of the charge roller 25 and the photoconductive imaging portion 23 may be determined via measuring the voltage $V_{CR}$ of the charge roller, such as via the power supply portion 42 in some examples. It will be understood that at least a measurement element(s) of the power supply portion 42 may comprise one example implementation of on-board measurement tool(s) 140, such as later schematically represented as voltage monitor 142 in association with at least FIG. 5A.

Figure 3:
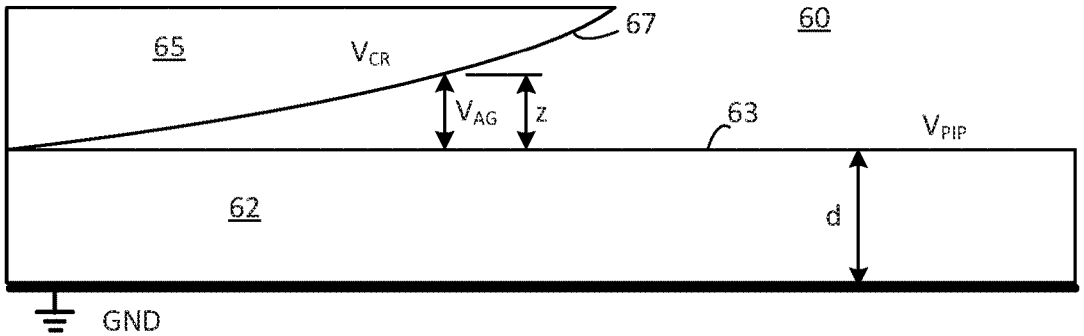
FIG. 3 is a diagram including a side view schematically representing an example charge roller in contact with an example photoconductive imaging portion.

FIG. 3 is a diagram including a side view schematically representing an example portion 60 of an electrophotographic printer in which a charge roller 65 is in rolling contact with, and charge-transferring relation to, a photoconductive imaging portion 62. In one aspect, the example portion 60 provides a reference by which the Paschen threshold voltage may be at least partially described.

In general terms, a Paschen threshold voltage, $V_{PS}(z)$, between two parallel conductive plates is a function of an air gap z between the respective plates. However, a charging threshold voltage $V_{th}$ for a charge roller (e.g. 65 in FIG. 3) in rolling contact with a photoconductive imaging portion 62 (FIG. 3) may be a function of a variable gap, such as an air gap (z) which may vary from 0 to a few tens of millimeters, as shown in FIG. 3. Moreover, the applied voltage ($V_{CR}$) from the charge roller 65 is divided between the air (e.g. $V_{AG}$) and photoconductive imaging portion 62 (e.g. $V_{PIP}$). With this in mind, the charging threshold voltage ($V_{th}$) by the contact charge roller 65 can be calculated from the minimum voltage across air ($V_{AG}$) that meets a Paschen threshold condition. The voltage across air ($V_{AG}$ or $V_a$) at a given charge roller voltage can be expressed by a voltage divider rule as:

$$V_a = V_{CR} \cdot \frac{z}{z + d/\varepsilon}, \quad \text{(Eq. 1)}$$

where $V_{CR}$ is the charge roller voltage, z is a size of the air gap, d is a photoconductor thickness, and ε is a dielectric constant of photoconductor, such as photoconductive imaging portion 62.

Figure 4:
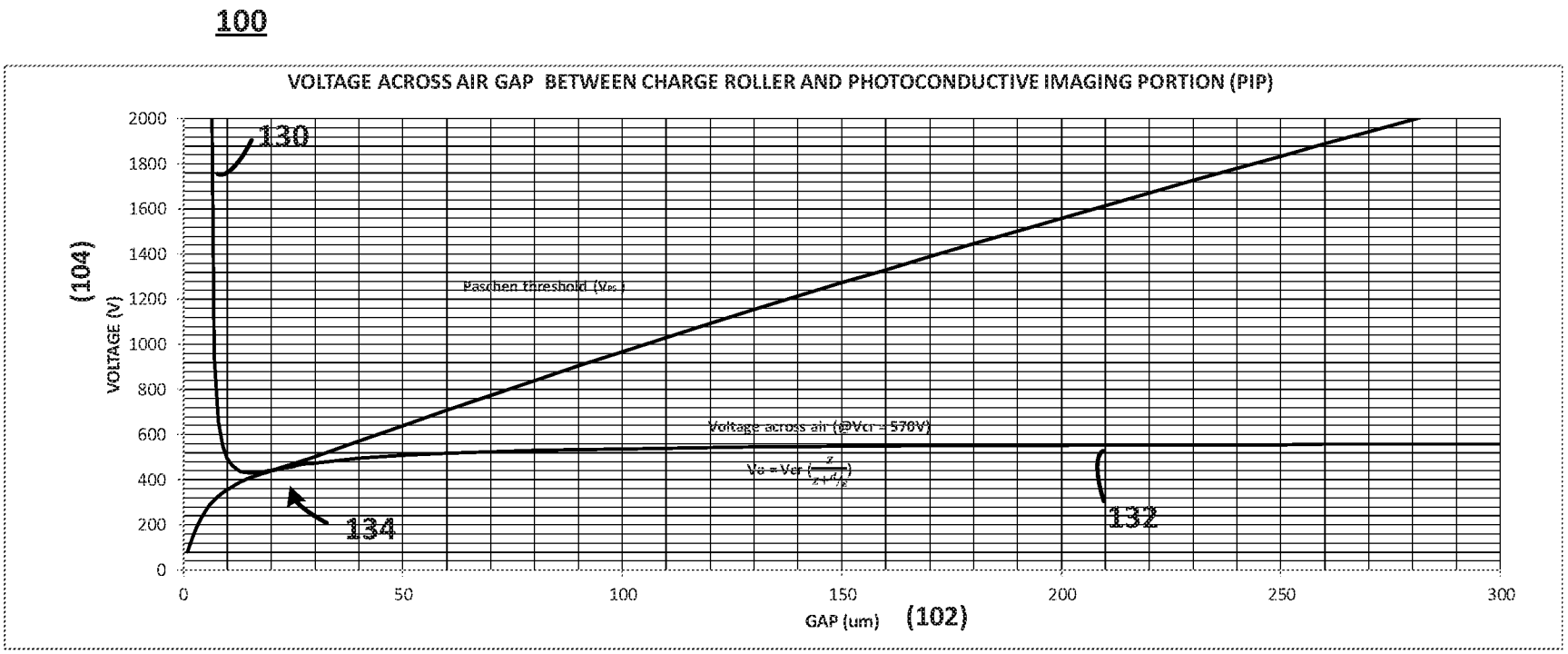
FIG. 4 is a graph schematically representing an example Paschen threshold voltage and example air gap voltage.

The charge roller voltage ($V_{CR}$) that results in the voltage across air to be the Paschen threshold voltage ($V_{PS}$) will be the charging threshold voltage ($V_{th}$). Since both the Paschen threshold voltage ($V_{PS}$) and voltage across air ($V_{AG}$ or $V_a$) depends upon the air gap z, the solution may be graphically solved in some examples. For example, in FIG. 4, both a Paschen threshold curve ($V_{TH}$ or $V_{PS}$) 130 and a voltage across air ($V_a$) 132 is plotted for a photoconductive imaging portion (e.g. 62 in FIG. 3) having a thickness of 18 micrometers (μm) and a dielectric constant (ε) of 3. In FIG. 4, the size of the air gap is plotted on the X-axis 102 while voltage is plotted on the Y-axis 104. As seen in FIG. 4, a minimum charge roller voltage $V_{CR}$ that results in a voltage across air ($V_a$) 132 which tangentially meets a Paschen curve ($V_{PS}$ or $V_{TH}$) is 570V, such as at 134. Therefore, in this particular example the charging threshold voltage ($V_{PS}$ or $V_{TH}$) is 570V. In some examples, an actual threshold depends upon the material of the charge roller 65 and is somewhere between 500V to 600V for a photoconductive imaging portion 62 which is made of a polycarbonate-based material, has a thickness of 18 micrometers (μm), and a dielectric constant (ε) of 3.

With this determination in mind, in some examples as in at least FIGS. 1, 5A, and 8-9, a charge roller may be spaced apart by a fixed air gap, and in charge-transferring relation to, a photoconductive imaging portion, such as shown in FIG. 5A. In such examples, no portion of the charge roller 125 contacts the photoconductive imaging portion 122. In some such examples, the charge roller 125 comprises a hard external surface 127 which, in the absence of a gap might otherwise possibly scratch a photoconductive imaging portion (e.g. 122 in FIG. 5A). Accordingly, in such examples it is desired to maintain a fixed air gap between the charge roller 125 and the photoconductive imaging portion 122.

With this in mind, a charging threshold voltage ($V_{TH}$) will be different for different sized air gaps between the charge roller 125 and the photoconductive imaging portion 122. In some examples, the charging threshold voltage ($V_{TH}$) can be calculated from the equation $$V_p = V_{CR} - V_{PS}(z) \cdot \frac{z + d/\varepsilon}{z}, \qquad \text{(Eq. 2)}$$

where $V_P$ is a voltage of the photoconductive imaging portion 122, $V_{CR}$ is a voltage of the charge roller, and $V_{PS}$ is a Paschen threshold voltage. Meanwhile, z represents a size of the air gap, d represents a thickness of the photoconductive imaging portion, and ε represents the dielectric constant of the photoconductive imaging portion. Charging will occur when $V_p>0$, and therefore, charging threshold voltage is $V_{TH}=V_{CR}=V_{PS}(g)\cdot(g+d/\varepsilon)/g$, where g is the gap between charge roller 125 and photoconductive imaging portion 122. It will be understood that the identifiers z and g may be interchangeably used to refer to the size of the air gap between the charge roller 125 and the photoconductive imaging portion 122. In some such examples, the air gap parameter g may comprise about 20 micrometers and also comprise a value at which air-ionization-type charging may begin to occur.

In some examples in which the photoconductive imaging portion 122 has a thickness (d) of 18 micrometers (μm), is made of polycarbonate material, and has a dielectric constant (ε) of 3, the photoconductive imaging portion 122 can exhibit a threshold increase of about 5V for each 1 micrometer (μm) increase in the size of the air gap (g or z).

Via such example arrangements, by detecting a Paschen threshold voltage at different sized air gaps (between a charge roller 125 and a photoconductive imaging portion 122), the size (e.g. quantitative value) of the respective air gaps can be back-calculated from the above-described Equation 1. All or some of this information in turn may be stored for later use so that when a charging threshold voltage is determined for a particular charge roller upon its installation and operation within an electrophotographic printer, the corresponding size of the air gap between the charge roller and the photoconductive imaging portion may be determined from the stored information.

In some examples, at least some of the above-described stored information may be implemented via the information 1012 stored in memory 1010 as part of control portion 1000, as further described later in association with at least FIGS. 10A-10B. In some such examples, this stored information may comprise a graphical representation, such as the graph 170 as shown in with FIG. 5B in which charging threshold voltage (Y-axis 174) is plotted relative to air gap size (X-axis 172). In some examples, this same or similar information may be represented and stored in tabular form, look up table, and/or other formats. In one non-limited example, the plotted curve 176 in graph 170 in FIG. 5B may be understood as communicating a range or array of charging threshold voltages having a one-to-one correspondence to a range or array of air gap sizes. For example, as shown per curve 176 in FIG. 5B, a charging threshold voltage of 700 Volts has a one-to-one correspondence of an air gap size of 48 micrometers, a charging threshold voltage of 600 Volts has a one-to-one correspondence of an air gap size of 30 micrometers, and so on. It will be further understood and apparent from this graphical representation in FIG. 5B that the air gap size may be determined in increments on the order of 10 micrometers or less via interpolation, via more precise graphical representation, etc. In some such examples, the air gap size may be determined in increments of 5 micrometers or less. In some such examples, the air gap size may be determined in increments of 1 micrometers. In some examples, the determined air gap size may be determined in increments which have a value falling within a range of about 1 micrometer to about 10 micrometers.

Accordingly, via establishing the size of the air gaps in relation to charging threshold voltages, this information may be used to determine a size of an air gap (e.g. z in FIG. 5A) via determination of the charging threshold voltage for a particular charge roller upon its installation into a printer at a spaced apart gap from a photoconductive imaging portion (e.g. 122 in FIG. 5A).

In some examples, for a given air gap (between a charge roller and a photoconductive imaging portion) and a voltage of the charge roller, the charging threshold voltage may be detected via a DC-mode of charge roller operation. This detected charging threshold information may be stored within and/or be accessible by a control portion to determine a size of an air gap of an installed charge roller using voltage measurement information for the charge roller upon its installation (at the time of assembly) in spaced, charge-transferring relation to a photoconductive imaging portion of an electrophotographic printer.

In some examples, the detection of the charging threshold in the DC mode is performed by increasing a DC component of a charge roller voltage until a non-zero current of the charge roller is detected or non-zero photoconductor voltage is detected.

In particular, in some such examples, the charge roller voltage ($V_{CR}$) is varied in direct current mode (DC) while detecting the charge roller current ($C_{CR}$) or photoconductor voltage. The charge roller voltage at which the first non-zero current is measured is the charging threshold voltage $V_{TH}$. In some such examples, a non-zero current corresponds to the charge roller and the spaced apart photoconductive imaging portion beginning to exhibit non-uniform charging behavior, such as but not limited to, filamentary streamer charges. For example, such filamentary streamer charges are further described in Chang U.S. Pat. No. 9,423,717, "Charge Roller For Electrophotographic Printer", issued Aug. 23, 2016 and/or Chang U.S. Patent Publication 2014/0369717, "Printing With Metal-Surface Charge Element in Glow Discharge Regime", published Dec. 18, 2014.

In some examples, the Paschen threshold (at which air ionization-based, "gapped" charging of a photoconductor may occur) may be detected in an AC-mode of charge roller operation. In some such examples, in the AC mode of operation an AC component of the charge roller voltage is increased until a voltage of the photoconductive imaging portion no longer increases. In particular, when an AC voltage is added to a DC voltage of a charge roller and if the AC frequency is high enough not to have spatial charge variation due to time-varying charging, then a maximum photoconductor voltage is $V_{CRDC}+V_{CRAC}-V_{TH}-V_{dark}$. In some such examples, $V_{CRDC}$ is the DC component of charge roller voltage, $V_{CRAC}$ is the AC component of charge roller voltage, $V_{th}$ is a charging threshold voltage, and $V_{dark}$ is the amount of photoconductor voltage decay from a charging region to a detection region. In some examples, the photoconductor voltage decay ($V_{dark}$) can be caused by either thermal dark decay or hole drift from a previous exposure of the photoconductor imaging portion to a discharging source.

Figure 6:
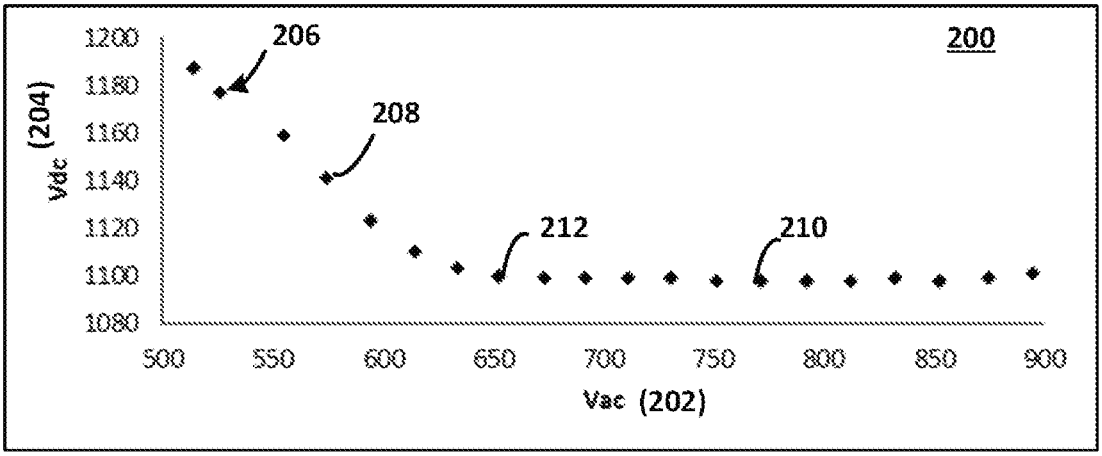
FIG. 6 is a graph schematically representing an example plot of a DC component of a charge roller voltage relative to an AC component of the charge roller voltage.
Figure 5B:
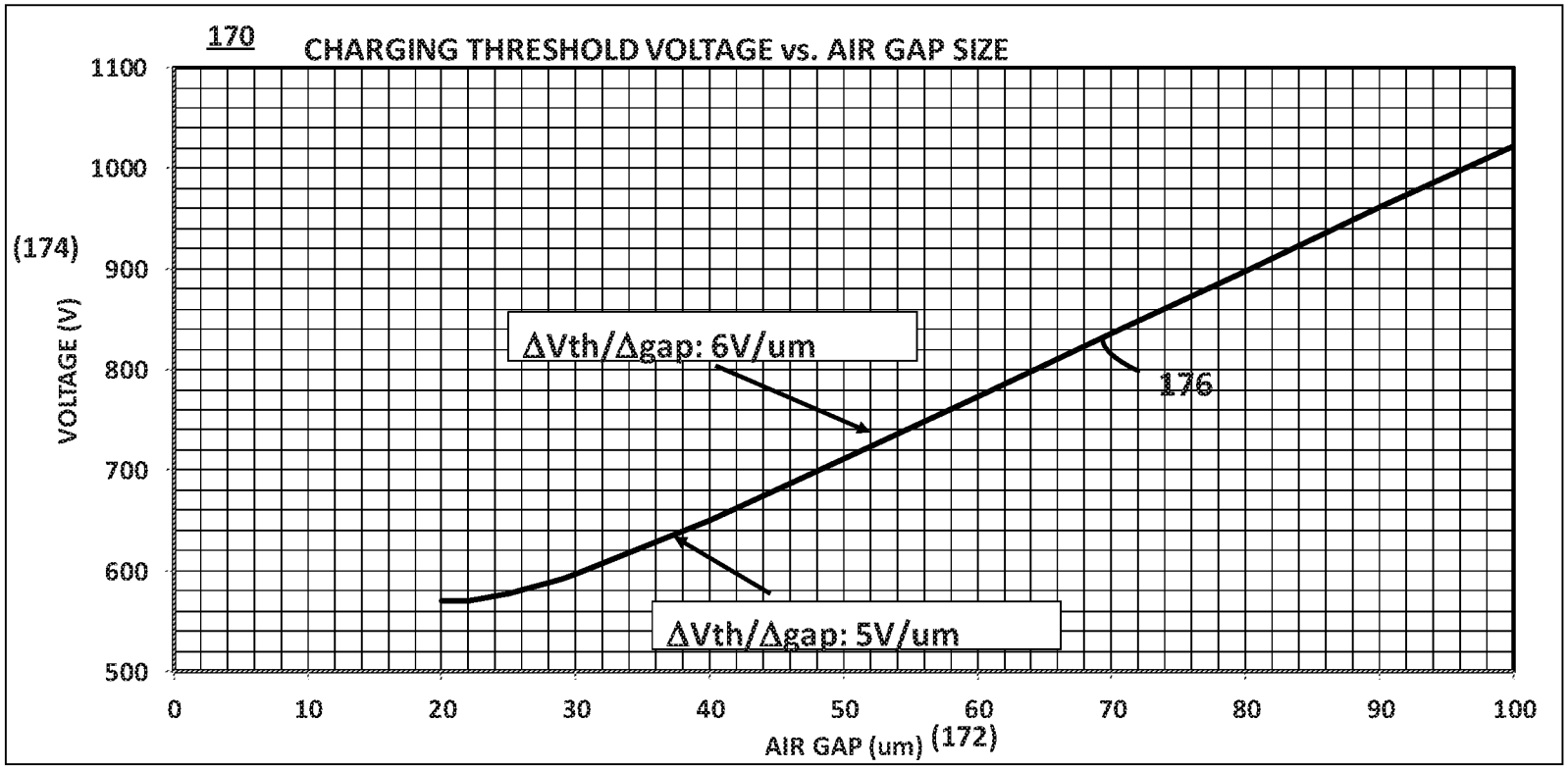
FIG. 5B is a graph schematically representing an example plot of charging threshold voltage relative to air gap size.

With this in mind, FIG. 6 provides one example illustration by which a charging threshold voltage $V_{TH}$ may be detected by varying an AC component of a charge roller voltage $V_{CRAC}$. As shown in FIG. 6, a Y-axis (204) of graph 200 represents a DC component of a charge roller voltage, which is plotted relative to an AC component (X-axis 202) and which may produce or result in a desired photoconductor voltage (e.g. 950V). This DC component of the charge roller voltage ($V_{CRAC}$) is plotted instead of plotting a photoconductor voltage $V_P$. According to the presence of the inflection point 212 along the X-axis (202) of the plot, the charging threshold $V_{TH}$ is 650V.

Via such example arrangements, as the AC voltage of the charge roller ($V_{CRAC}$) is increased, the photoconductor voltage increases. However, when $V_{CRAC}$ exceeds a charging threshold voltage $V_{TH}$, the photoconductor voltage doesn't increase any more due to balanced charging and discharging from the up-cycle and down-cycle of the AC. The AC voltage of the charge roller ($V_{CRAC}$) at which photoconductor voltage no longer increases corresponds to the charging threshold voltage $V_{TH}$. Therefore, the charging threshold voltage $V_{TH}$ (i.e. the Paschen threshold voltage) also can be detected from an AC-mode operation by varying the AC voltage of the charge roller, as described above.

In view of the various above-described example arrangements, in order to calculate the air gap between a charge roller and a photoconductive imaging portion (as part of the stored information), the following formula can be used, as an example. The charging threshold voltage ($V_{TH}$) in a contact mode is 570V, with the contact mode corresponding to an air gap of zero in which a charge roller is in rolling contact with a photoconductive imaging portion. The contact mode stands in contrast to a gapped mode of operation in which a charge roller is in charge-transferring relation to a photoconductive imaging portion via a fixed air gap between the charge roller and the photoconductive imaging portion.

With this example in mind, because there is a 80V difference in a charging threshold voltage ($V_{TH}$) between a gapped mode and a contact mode, the gap is 20 μm+80V/(5V/μm)=36 μm. In this situation, the 20 μm value is used because at air gap sizes up to 20 μm, the charging threshold voltage doesn't change.

Figure 7:
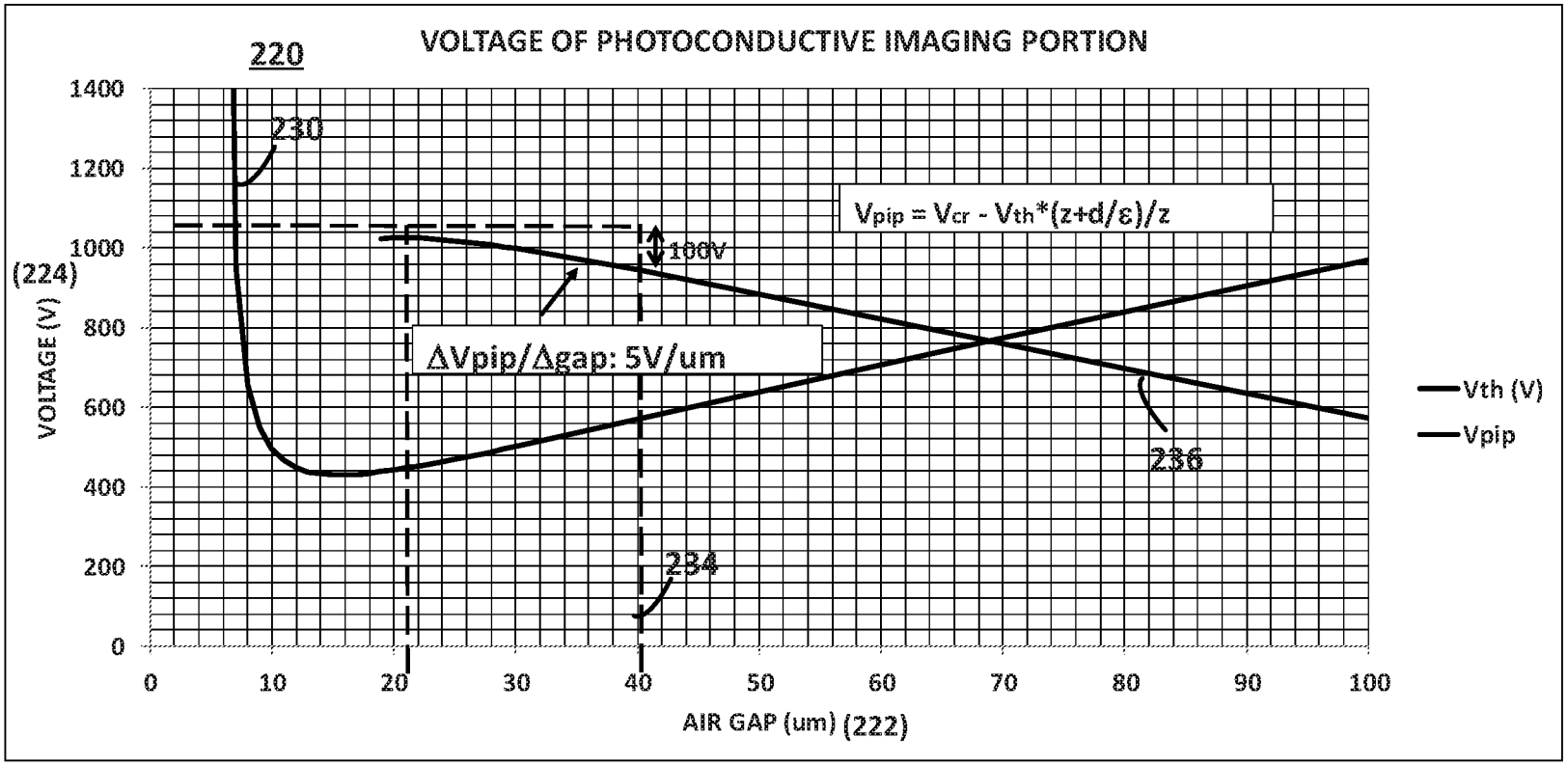
FIG. 7 is a graph schematically representing an example Paschen threshold voltage plotted relative to an example voltage for a photoconductive imaging portion.

With at least these example arrangements in mind, FIG. 7 provides a graph 220 which illustrates a Paschen threshold voltage ($V_{TH}$) 230 and illustrates, for a fixed DC voltage $V_{DC}$ for a charge roller (e.g. 125 in FIG. 5A), a quantity by which the voltage of the photoconductive imaging portion $V_{PIP}$ 236 changes (Y-axis 224) according to a change in the size of the air gap (X-axis 220). As shown in FIG. 7, for a change of 20 μm to 40 μm, a rate of voltage $V_{PIP}$ change per micrometer starts at about 5V/μm and becomes about 6V/μm above a 40 μm air gap.

With this in mind, further information may be developed regarding a calculation of a charging threshold voltage versus an air gap. For example, in general terms at a fixed charge roller voltage in a DC-mode, as a size of the air gap increases (X-axis 222), a voltage of a photoconductive imaging portion $V_{PIP}$ decreases. However, for an air gap from 0 micrometers up to 20 μm, the photoconductive voltage (Y-axis 224) doesn't change because there is no Paschen discharge for an air gap of 0 micrometers up to an air gap of 20 micrometers. However, above the 20 micrometer gap at which Paschen discharge behavior (i.e. gas ionization) occurs, the photoconductive voltage $V_{PIP}$ decreases at a rate of about 5V/μm. Stated differently, for each one micrometer increase in a size of the air gap, a 5 Volt decrease in the photoconductive voltage $V_{PIP}$ occurs. When the size of the air gap is larger (e.g. more than 40 micrometers), this rate of change of decreasing photoconductive voltage $V_{PIP}$ increases to a 6 Volt decrease in photoconductive voltage $V_{PIP}$ for each one micrometer increase in the air gap size, which may be expressed as 6V/μm. Accordingly, for each one micrometer (μm) change in the size of the air gap, a corresponding change in the photoconductor voltage $V_{PIP}$ of 5V (for a gap between 20 and 40 micrometers) may be observed.

Therefore, upon knowing or measuring the charging threshold voltage, one can determine the size of the air gap between the charge roller (e.g. 125 in FIG. 5A) and the photoconductive imaging portion (e.g. 122 in FIG. 5A) without using an external measurement tool.

Figure 8:
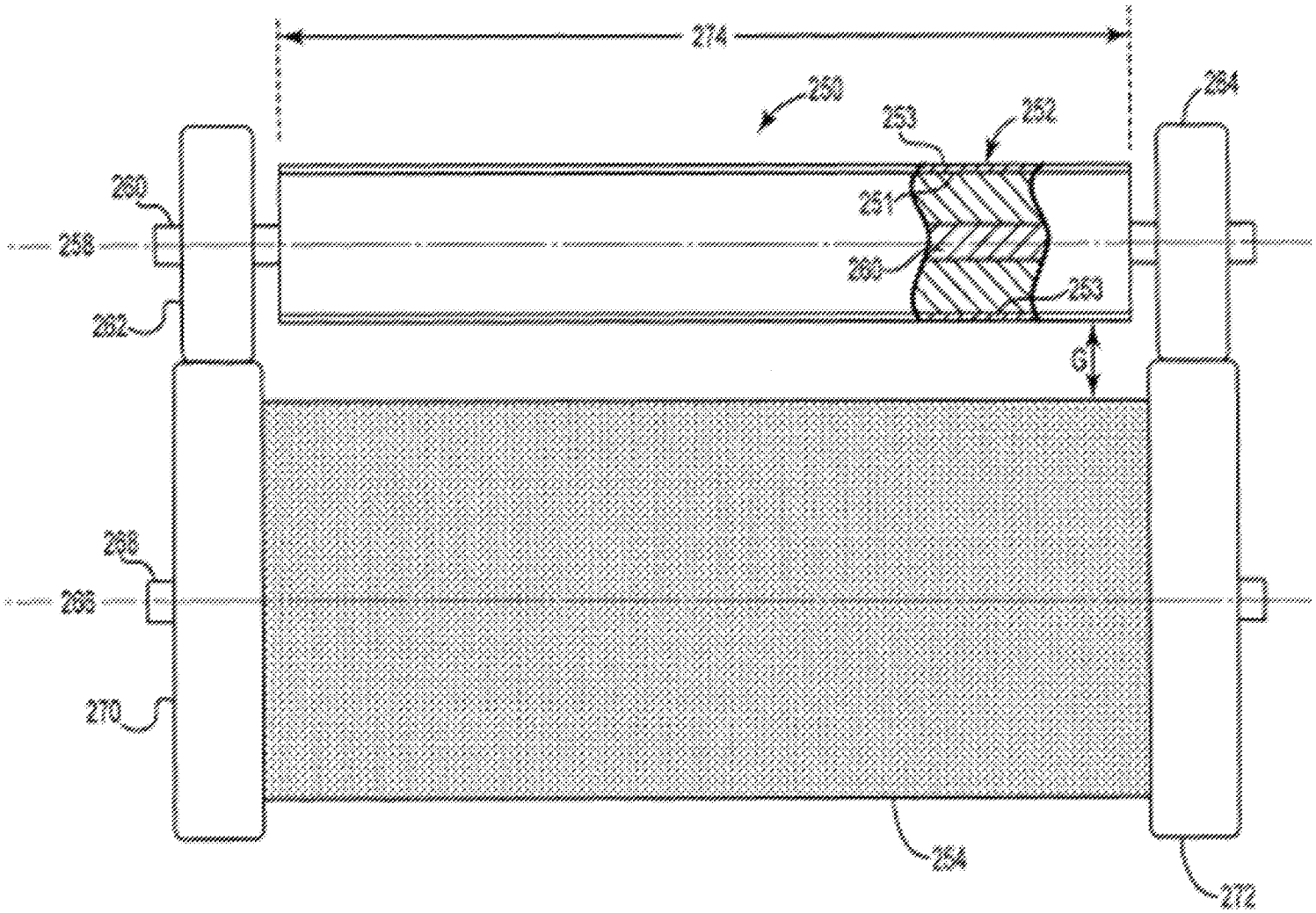
FIG. 8 is a side view schematically representing an example portion of an electrophotographic printer including a charge roller positioned with a gap relative to an example photoconductive imaging portion.

FIG. 8 is a side view schematically representing an example printing system 250 having a charge roller 252 rotationally coupled to, but spaced apart from, an external surface 254 of a photoconductive imaging portion by a fixed air gap G. In general terms, the example printing system 250 includes at least some of substantially the same features and attributes as the electrophotographic printers, and portions thereof, as described in association with FIGS. 1-7. In some examples, the gap (G) is any distance between 0 and 80 micrometers (μm). In some examples, the gap (G) is between about 20 micrometers and about 80 micrometers (μm). In some such examples, the upper limit (e.g. 80 micrometers) of the range may be even larger if adequate, uniform charge transfer can be achieved from the charge roller 252 to the surface 254 of the photoconductive imaging portion.

As further shown in FIG. 8, the charge roller 252 rotates about an axis 258 by means of a shaft 260 coupled to a drive wheel 262 on one end and a drive wheel 264 on the other end. Meanwhile, the surface 254 of the photoconductive imaging portion rotates about an axis 266 by means of a shaft 268 with a first disk 270 on one end and a second disk 272 on the other end. With this arrangement, the charge-roller drive wheel 262 engages the first disk 270, and the charge-roller drive wheel 264 engages the second disk 272. In some examples, there may be more or fewer drive wheels and disks, and rotational torque to the photoconductive imaging portion may be provided by a motor (not shown) through a gear (not shown) attached to the shaft 268. Finally, the charge roller 252 defines an image area 274 relative to the photoconductive imaging surface 254.

Figure 9:
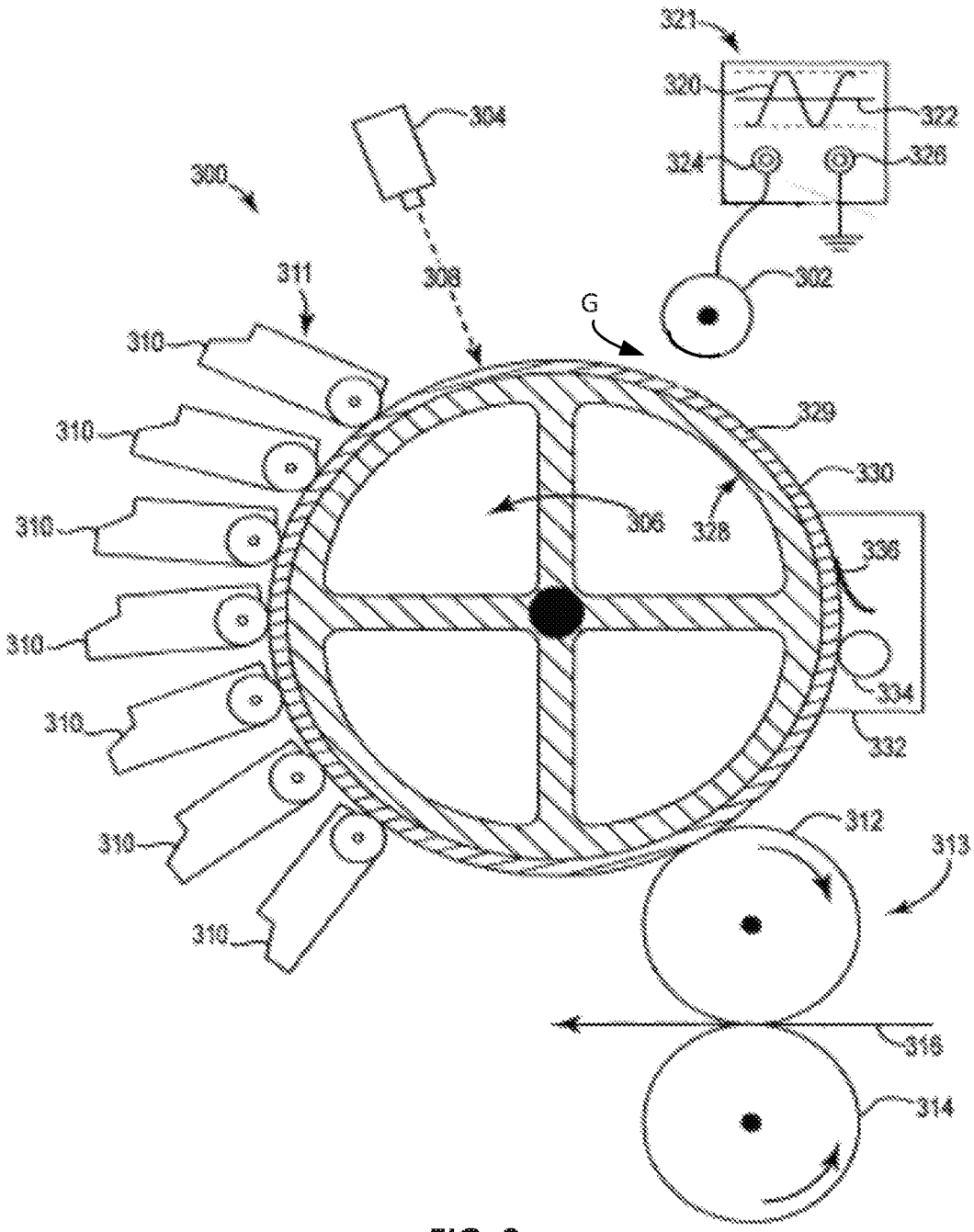
FIG. 9 is a side view schematically representing an example portion of an electrophotographic printer.

FIG. 9 is a side view schematically illustrating an example printer 300 having a charge roller 302 in charge-transferring relation with a photoconductive imaging portion 330, according to one example of the present disclosure. In one example, charge roller 302 includes at least some of substantially the same features and attributes as one of charge rollers positioned at a fixed air gap relative to a photoconductive imaging portion, as previously described in association with at least FIGS. 1-8. Accordingly, upon installing charge roller 302 into the printer 300 at the time of assembly, a fixed air gap between the charge roller 302 and a photoconductive imaging portion 330 may be determined according to the examples of the present disclosure as described in association with at least FIGS. 1-8 and 10A-11. Via such examples, measurement of a voltage of the charge roller, in relation to a Paschen threshold voltage and an air gap voltage, may be used to determine a size of the air gap G. This determination of the air gap size may be used to implement substantially uniform charging of the photoconductive imaging portion 330 via the charge roller 302, upon confirmation that the determined air gap size falls within a desired range, as previously described in association with at least FIGS. 1-8.

In one example, printer 300 comprises an electrophotographic printer, and in some such examples, printer 300 comprises a liquid electrophotographic printer.

As shown in FIG. 9, printer 300 includes a charge roller 302, a photoconductive imaging portion 330, a discharge source 304, a developer array 311, a transfer unit 313, a cleaner 332, and a power supply 321. In one aspect, via a gap G the charge roller 302 is in charge-transferring relation to photoconductive imaging portion 330 with the size of the air gap G falling within a range of sizes which can produce a substantially uniform charge on photoconductive imaging portion 330, as previously described in various examples of the present disclosure.

In one aspect, the discharge source 304 is aimed at the imaging surface 330 as indicated by an arrow 308. At least one ink developer roller 310 of array 311 is disposed in ink-dispensing relation with the imaging surface 330. While FIG. 9 depicts one example including seven ink dispenser rollers 310 in an array 311, in other examples fewer or more ink dispenser rollers 310 may be used. The transfer unit 313 is generally in ink-transferring relation with the photoconductive imaging portion surface 330 and defines a media movement path 316.

In some examples, the transfer unit 313 comprises an intermediate transfer drum 312 and an impression drum 314. The transfer drum 312 is rotationally coupled to and in direct contact with the photoconductive imaging portion 330 while the impression drum 314 is rotationally coupled to the intermediate transfer drum 312. The paper movement path 316 is defined between the intermediate transfer drum 312 and the impression drum 314.

In some examples, photoconductive imaging portion 330 comprises a photoconductive sheet 329 carried by a drum 328. In some instances, the photoconductive sheet 329 is referred to as an organic photoconductor (OPC) because of the organic material forming the photoconductive sheet 329. In other instances, the photoconductive sheet 329 is referred to as a photo imaging plate (PIP). As discussed previously, fabric or other material (not shown) may be disposed between the drum 328 and the photoconductive sheet 329. In some examples, the photoconductive imaging portion 330 may comprise a dielectric drum or a photoconductor drum.

In some examples, the discharge source 304 comprises a laser. In operation, when a beam of light from the laser reaches points on the electrostatically-charged photoconductive imaging portion 330, the light discharges the surface at those points. A charge image is formed on the photoconductive imaging portion 330 by scanning the beam of light across the imaging portion 330. In other examples, other types of image-forming energy sources or addressable discharging systems are used, such as an ion head or other gated atmospheric charge source. The particular type of image-forming energy source used in printer 300 depends on what kind of imaging surface is being used.

In one example, printer 300 includes cleaner 332 as noted above. For instance, cleaner 332 includes a roller element 334 and a scraping or brushing element 336, or other devices to remove any excess ink remaining on the imaging surface 330 after transferring imaged ink to the transfer roller 312. In some examples, roller element 334 includes a single roller while in other examples, roller element 334 includes at least two rollers, such as one wetting roller and one sponge roller.

In one example, the power supply 321 provides electric power with an AC component 320 and a DC component 322. The power supply is connected to the charge roller 302 through a first terminal 324 in electrical communication with the charge roller 302 and a second terminal 326 in electrical communication with ground.

In some examples, a voltage potential between the charge roller 302 and the ground plane (associated with the photoconductive imaging portion 330) is a combination of a DC voltage and an AC voltage. In other examples, the voltage between the charge roller 302 and the ground plane is a DC voltage.

Figure 10A:
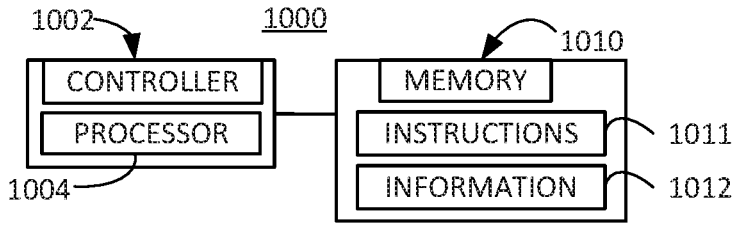
FIG. 10A is a block diagram schematically representing an example control portion.

FIG. 10A is a block diagram schematically representing an example control portion 1000. In some examples, control portion 1000 provides one example implementation of a control portion forming a part of, implementing, and/or generally managing the example portions of and/or entire electrophotographic printers, as well as the particular charge rollers, photoconductors, power supplies, voltage controls, elements, devices, instructions, information, engines, and/or methods, as described throughout examples of the present disclosure in association with FIGS. 1-9 and 10B-11.

In some examples, control portion 1000 includes a controller 1002 and a memory 1010. In general terms, controller 1002 of control portion 1000 comprises at least one processor 1004 and associated memories. The controller 1002 is electrically couplable to, and in communication with, memory 1010 to generate control signals to direct operation of at least some of the portions of, and/or entire, electrophotographic printers, such as but not limited to, the charge rollers, photoconductors, power supplies, voltage controls, charge sources, transfer stations, developer units, user interfaces, instructions, information, engines, elements, functions, and/or methods, as described throughout examples of the present disclosure. In some examples, these generated control signals include, but are not limited to, employing instructions 1011 and/or information 1012 stored in memory 1010 to at least direct and manage determining a size of an air gap between a charge roller and a photoconductor imaging portion, charging the charge roller, charging the photoconductor imaging portion, discharging portions of the photoconductor imaging portion to form an image, developing ink(s) on the image on discharged portions, transferring the ink image onto an intermediate transfer member and/or onto an image formation medium, etc. as described throughout the examples of the present disclosure in association with FIGS. 1-9 and 10B-11. In some instances, the controller 1002 or control portion 1000 may sometimes be referred to as being programmed to perform the above-identified actions, functions, etc. In some examples, at least some of the stored instructions 1011 are implemented as, or may be referred to as, a print engine or image formation engine. In some examples, at least some of the stored instructions 1011 and/or information 1012 may form at least part of, and/or, may be referred to as a charge roller gap determination engine.

In response to or based upon commands received via a user interface (e.g. user interface 1020 in FIG. 11) and/or via machine readable instructions, controller 1002 generates control signals as described above in accordance with at least some of the examples of the present disclosure. In some examples, controller 1002 is embodied in a general purpose computing device while in some examples, controller 1002 is incorporated into or associated with at least some of the portions of, and/or the entire, electrophotographic printers, as well as the particular charge rollers, photoconductors, power supplies, voltage controls, developer units, transfer stations, elements, devices, instructions, information, engines, functions, and/or method, etc. as described throughout examples of the present disclosure.

For purposes of this application, in reference to the controller 1002, the term "processor" shall mean a presently developed or future developed processor (or processing resources) that executes sequences of machine readable instructions contained in a memory. In some examples, execution of the sequences of machine readable instructions, such as those provided via memory 1010 of control portion 1000 cause the processor to perform the above-identified actions, such as operating controller 1002 to implement the image formation and charge roller gap determination as generally described in (or consistent with) at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium), as represented by memory 1010. In some examples, memory 1010 comprises a computer readable tangible medium providing non-volatile storage of the machine readable instructions executable by a process of controller 1002. In some examples, the computer readable tangible medium may sometimes be referred to as, and/or comprise at least a portion of, a computer program product. In other examples, hard wired circuitry may be used in place of or in combination with machine readable instructions to implement the functions described. For instance, in some examples, at least the controller 1002 and/or other components of the control portion 1000 may be embodied as part of at least one application-specific integrated circuit (ASIC), at least one field-programmable gate array (FPGA), and the like. In at least some examples, the controller 1002 and/or other components of the control portion 100 are not limited to any specific combination of hardware circuitry and machine readable instructions, nor limited to any particular source for the machine readable instructions executed by the controller 1002.

In some examples, control portion 1000 may be entirely implemented within or by a stand-alone device.

In some examples, the control portion 1000 may be partially implemented in one of the image formation devices and partially implemented in a computing resource separate from, and independent of, the image formation devices but in communication with the image formation devices. For instance, in some examples control portion 1000 may be implemented via a server accessible via the cloud and/or other network pathways. In some examples, the control portion 1000 may be distributed or apportioned among multiple devices or resources such as among a server, an image formation device, and/or a user interface.

Figure 10B:
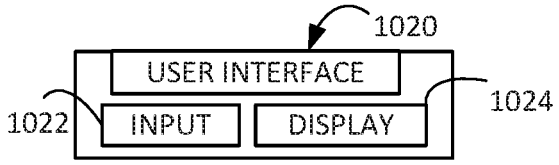
FIG. 10B is a block diagram schematically representing an example user interface.

In some examples, control portion 1000 includes, and/or is in communication with, a user interface 1020 as shown in FIG. 10B. In some examples, user interface 1020 comprises a user interface or other display that provides for the simultaneous display, activation, and/or operation of at least some of the portions of, and/or the entire, electrophotographic printers (e.g.) as well as the particular charge rollers, photoconductors, power supplies, voltage controls, developer units, transfer stations, elements, devices, instructions, information, engines, functions, and/or method, etc., as described in association with FIGS. 1-9 and 10B-11. In some examples, at least some portions or aspects of the user interface 1020 are provided via a graphical user interface (GUI), and may comprise a display 1024 and input 1022.

Figure 11:
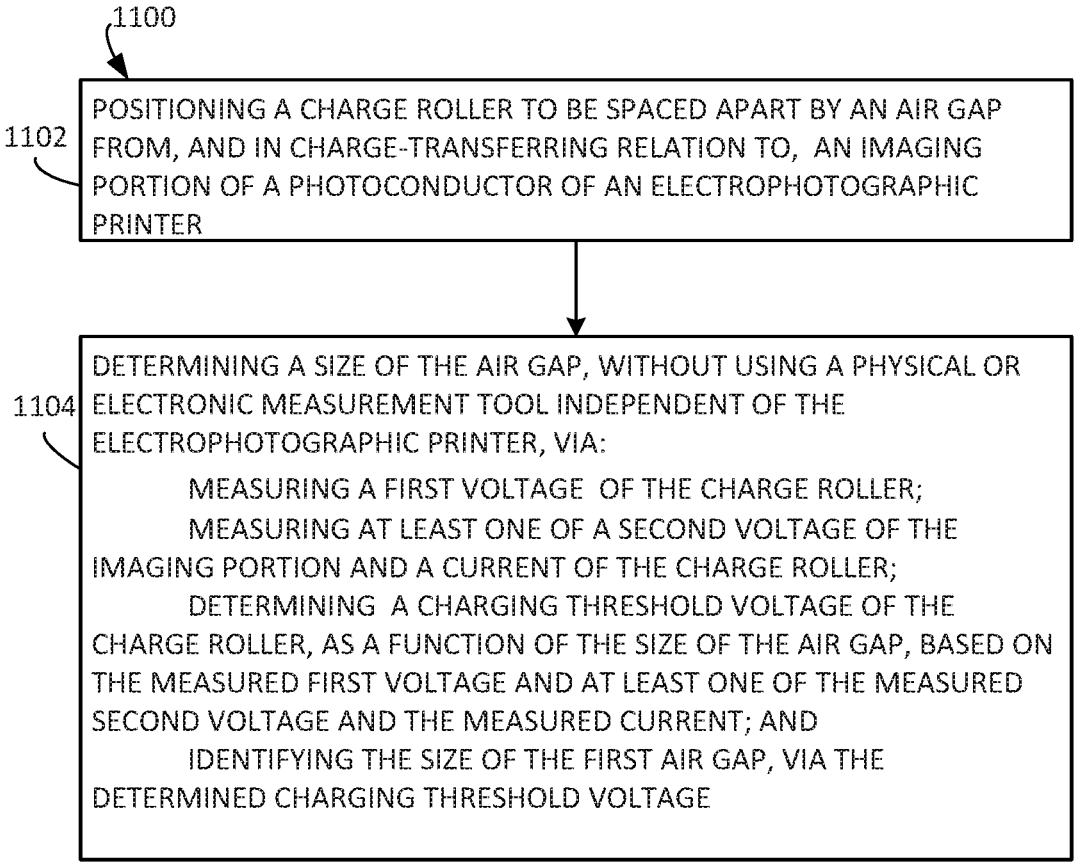
FIG. 11 is a flow diagram schematically representing an example method.

FIG. 11 is a flow diagram schematically representing an example method. In some examples, method 1100 may be performed via at least some of the same or substantially the same printers, charge rollers, power supplies, photoconductors, portions, elements, control portion, methods, etc. as previously described in association with FIGS. 1A-10B. In some examples, method 1100 may be performed via at least some printers, charge rollers, power supplies, photoconductors, portions, elements, control portion, methods, etc., other than those previously described in association with FIGS. 1A-10B.

As shown at 1102 of FIG. 11, in some examples method 1100 comprises positioning a charge roller to be spaced apart by an air gap from, and in charge-transferring relation to, an imaging portion of a photoconductor of an electrophotographic printer.

As shown at 1104, in some examples method 1100 comprises determining a size of the first air gap, without using a physical or electronic measurement tool independent of the electrophotographic printer. In some such examples, the determination is made via: measuring a first voltage of the charge roller; measuring at least one of a second voltage of the imaging portion (of the photoconductor) and a current of the charge roller; and determining a charging threshold voltage of the charge roller, as a function of the size of the air gap, based on the measured first voltage and at least one of the measured second voltage and the measured current; and identifying the size of the first air gap, via the determined charging threshold voltage. In some such examples, the identification of the size of the air gap is performed according to an array of different charging threshold voltages, including the determined charging threshold voltage, which correspond to an array of differently sized air gaps, including the size of the first air gap.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A device comprising:

a charge roller removably insertable into charge-transferring relation to, at a first air gap from, a photoconductive imaging portion of an electrophotographic printer; and a control portion to:

determine a charging threshold voltage associated with at least the charge roller;

and determine a size of the first air gap, via the determined charging threshold voltage, based on an array of different charging threshold voltages, including the determined charging threshold voltage, corresponding to an array of differently sized air gaps, including the size of the first air gap.

2. The device of claim 1, wherein the control portion is to receive a first measured voltage of the charge roller, to receive at least one of a second measured voltage of the photoconductive imaging portion and a measured current of the charge roller, and wherein the control portion is determine the charging threshold voltage based on the first measured voltage and based on at least one of the second measured voltage and the measured current of the charge roller.

3. The device of claim 2, wherein the determination of the charging threshold voltage is based on a third voltage across the first air gap which meets a Paschen threshold condition, the third voltage calculated from the respective first and second measured voltages.

4. The device of claim 2, wherein the control portion is to determine the charging threshold voltage via at least one of:

a DC mode in which a DC component of the first measured voltage of the charge roller is increased until a non-zero value of the measured current of the charge roller is detected; and an AC mode in which an AC component of the first measured voltage of the charge roller is increased until the second measured voltage of the photoconductive imaging portion no longer increases.

5. The device of claim 1, wherein the control portion is to determine the size of the first air gap and the measurement of the first voltage of the charge roller, without receiving physical measurement information or electronic measurement information obtained via instrumentation separate from, and independent of, the electrophotographic printer.

6. The device of claim 1, wherein the control portion is to determine the size of the first air gap in increments within a range of about 1 micrometer to about 10 micrometers.

7. The device of claim 1, the control portion comprising:

a processor; and a non-transitory tangible medium storing the instructions as machine-readable instructions, executable by the processor.

8. The device of claim 1, wherein the charge roller comprises an external surface comprises a metal surface and a resistive coating overlying the metal surface, wherein the resistive coating comprises an inorganic, non-polymeric material.

9. The device of claim 1, wherein the electrophotographic printer further comprises:

a discharge source aimed at the photoconductive imaging portion;

at least one ink developer roller in ink-dispensing relation with the photoconductive imaging portion; and a transfer unit to arrange an image formation medium in ink-transferring relation with at least one of:

the photoconductive imaging portion; and an intermediate transfer member in ink-transferring relation to the photoconductive imaging portion.

10. A computer program product comprising:

a non-transitory tangible medium storing machine-readable instructions, executable by a processor, to determine a size of a first air gap between an external surface of a removably insertable charge roller and a photoconductive imaging portion of an electrophotographic printer, the determination via the stored instructions comprising:

determination of a charging threshold voltage associated with at least the charge roller and as a function of the size of the air gap; and identifying the size of the first air gap in increments between about 1 micrometer and 10 micrometers.

11. The computer program product of claim 10, wherein the stored instructions comprise stored instructions to receive a first measured voltage of the charge roller, to receive at least one of a second measured voltage of the photoconductive imaging portion and a measured current of the charge roller, and wherein the instructions are to determine the charging threshold voltage based on the first measured voltage and based on at least one of the second measured voltage and the measured current of the charge roller.

12. A method comprising:

positioning a charge roller to be spaced apart by a first air gap from, and in charge-transferring relation to, an imaging portion of a photoconductor of an electrophotographic printer; and determining a size of the first air gap, without using a physical or electronic measurement tool independent of the electrophotographic printer, via:

measuring a first voltage of the charge roller;

measuring at least one of a second voltage of the imaging portion and a current of the charge roller; and determining a charging threshold voltage of the charge roller, as a function of the size of the air gap, based on the measured first voltage and at least one of the measured second voltage and the measured current; and identifying the size of the first air gap, via the determined charging threshold voltage, according to an array of different charging threshold voltages, including the determined charging threshold voltage, which correspond to an array of differently sized air gaps, including the size of the first air gap.

13. The method of claim 12, comprising:

performing the determination of the size of the first air gap according to increments on the order of ten micrometers or less.

14. The method of claim 12, comprising:

determining the charging threshold voltage via at least one of:

a DC mode in which a DC component of the first voltage of the charge roller is increased until a non-zero value of the measured current of the charge roller is detected; and an AC mode in which an AC component of the first voltage of the charge roller is increased until the second voltage of the imaging portion no longer increases.

15. The method of claim 12, comprising:

arranging the external surface of the charge roller as a metal surface and a resistive coating overlying the metal surface, and wherein the resistive coating comprises an inorganic, non-polymeric material.

* * * * *